US009624754B2

(12) United States Patent
Merron et al.

(10) Patent No.: US 9,624,754 B2
(45) Date of Patent: Apr. 18, 2017

(54) RADIUSED ID BAFFLE

(71) Applicant: Halliburton Energy Services, Inc., Houston, TX (US)

(72) Inventors: Matt James Merron, Dallas, TX (US); Zachary William Walton, Coppell, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 441 days.

(21) Appl. No.: 13/852,493

(22) Filed: Mar. 28, 2013

(65) Prior Publication Data

US 2014/0290947 A1 Oct. 2, 2014

(51) Int. Cl.

| | |
|---|---|
| ***E21B 34/10*** | (2006.01) |
| ***E21B 34/06*** | (2006.01) |
| ***E21B 34/14*** | (2006.01) |
| ***E21B 43/114*** | (2006.01) |

(52) U.S. Cl.

CPC ..... *E21B 34/06* (2013.01); *E21B 34/10* (2013.01); *E21B 34/14* (2013.01); *E21B 43/114* (2013.01)

(58) Field of Classification Search

CPC ..... E21B 21/103; E21B 34/10; E21B 43/263; E21B 43/26; E21B 34/14

See application file for complete search history.

(56) References Cited

U.S. PATENT DOCUMENTS

| | | | | |
|---|---|---|---|---|
| 2,834,578 | A * | 5/1958 | Carr | 175/237 |
| 5,146,992 | A * | 9/1992 | Baugh | E21B 34/14 166/154 |
| 7,874,365 | B2 | 1/2011 | East, Jr. et al. | |
| 8,074,718 | B2 | 12/2011 | Roberts | |
| 8,104,539 | B2 | 1/2012 | Stanojcic et al. | |
| 8,336,628 | B2 | 12/2012 | Myerley | |
| 2010/0044041 | A1 | 2/2010 | Smith et al. | |
| 2010/0065125 | A1* | 3/2010 | Telfer | E21B 21/103 137/1 |
| 2010/0243253 | A1 | 9/2010 | Surjaatmadja et al. | |
| 2011/0278017 | A1 | 11/2011 | Themig et al. | |
| 2011/0284232 | A1* | 11/2011 | Huang | 166/317 |
| 2012/0012322 | A1* | 1/2012 | Korkmaz et al. | 166/308.1 |
| 2012/0012771 | A1 | 1/2012 | Korkmaz et al. | |
| 2012/0205120 | A1 | 8/2012 | Howell | |
| 2012/0205121 | A1 | 8/2012 | Porter et al. | |
| 2013/0048291 | A1 | 2/2013 | Merron et al. | |
| 2013/0048298 | A1 | 2/2013 | Merron | |
| 2013/0068474 | A1* | 3/2013 | Hofman | E21B 34/08 166/373 |

FOREIGN PATENT DOCUMENTS

| | | |
|---|---|---|
| WO | 2012003419 A2 | 1/2012 |

OTHER PUBLICATIONS

International Search Report and Written Opinion in related PCT Application No. PCT/US2014/031593, mailed on Jan. 12, 2015 (9 pages).

* cited by examiner

*Primary Examiner* — Cathleen Hutchins
(74) *Attorney, Agent, or Firm* — John W. Wustenberg; Baker Botts L.L.P.

(57) ABSTRACT

A method for servicing a subterranean formation comprising providing a wellbore penetrating the subterranean formation, and placing a wellbore servicing tool in the wellbore, wherein the wellbore servicing tool comprises a baffle, wherein the baffle comprises a seat contoured to match a spherical zone of an obturator.

20 Claims, 5 Drawing Sheets

RADIUSED ID BAFFLE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are sometimes formed in a subterranean formation which contains a hydrocarbon. In some wellbore servicing systems and methods, tools for use in treating and/or otherwise managing the subterranean formation may be activated by an obturator. In some cases, an obturator in the form of a ball may be used to activate a tool, for example, thereby allowing fluid communication between the tool and a space exterior to the tool. To deactivate the tool, the ball may be moved. However, the force required to move the ball can be high. Accordingly, there exists a need for improved systems and methods of servicing a wellbore.

SUMMARY

Disclosed herein is a method for servicing a subterranean formation comprising providing a wellbore penetrating the subterranean formation, and placing a wellbore servicing tool in the wellbore, wherein the wellbore servicing tool comprises a baffle, wherein the baffle comprises a seat contoured to match a spherical zone of an obturator.

Also disclosed herein is a wellbore servicing tool comprising an obturator comprising a spherical zone, and a baffle comprising a seat contoured to match the spherical zone of the obturator.

Further disclosed herein is a baffle for use in a wellbore servicing operation comprising a seat contoured to match a spherical zone of an obturator.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
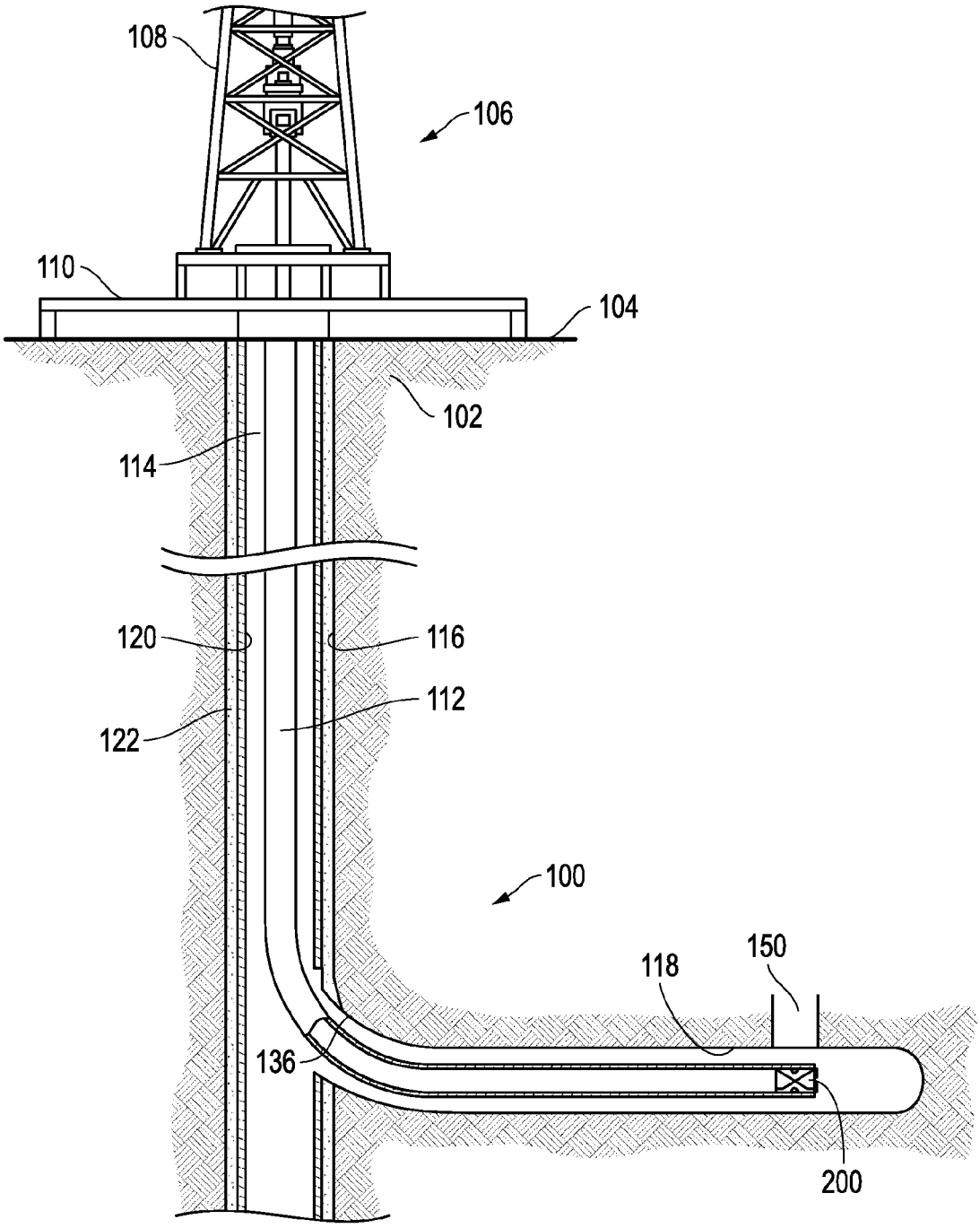
FIG. 1 is a partial cut-away view of an embodiment of a wellbore operating environment.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of wellbore servicing apparatus, as well as systems and methods that may be utilized in performing the same. Particularly, disclosed herein are one or more embodiments of a wellbore servicing tool and methods for use thereof. The wellbore servicing tool generally utilizes a baffle and an obturator received by the baffle. The baffle may have configurations described herein such that an ejection pressure for disengaging the obturator from the baffle is relatively low. For example, ejection pressures when using conventional baffles may range above 800 psi; whereas, the ejection pressure for the embodiments disclosed herein may comprise less that 800 psi; alternatively, less than about 700 psi; alternatively, less than about 600 psi; alternatively, less than about 500 psi; alternatively, less than about 400 psi; alternatively, less than about 300 psi; alternatively, less than about 200 psi; alternatively, less than about 100 psi; alternatively, about 100 psig.

Referring to FIG. 1, an embodiment of a wellbore servicing system 100 is shown in an example of an operating environment. As depicted, the operating environment comprises a servicing rig 106 (e.g., a drilling, completion, or workover rig) that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 may extend substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved.

At least a portion of the vertical wellbore portion 116 is lined with a casing 120 that is secured into position against the subterranean formation 102 in a conventional manner, for example, using cement 122. In alternative operating environments, a horizontal wellbore portion 118 may be cased and cemented and/or portions of the wellbore may be uncased. The servicing rig 106 may comprise a derrick 108 with a rig floor 110 through which a tubing or work string 112 (e.g., cable, wireline, E-line, Z-line, jointed pipe, coiled tubing, casing, liner, drill string, tool string, segmented tubing string, a jointed tubing string, combinations thereof, etc.) extends downward from the servicing rig 106 into the wellbore 114 and defines an annulus 128 between the work string 112 and the wellbore 114. The work string 112 delivers the wellbore servicing system 100 to a selected depth within the wellbore 114 to perform an operation such as perforating the casing 120 and/or subterranean formation 102, creating perforation tunnels and/or fractures (e.g., dominant fractures, micro-fractures, etc.) within the subterranean formation 102, producing hydrocarbons from the subterranean formation 102, and/or other completion operations. The servicing rig 106 comprises a motor driven winch and other associated equipment for extending the work string 112 into the wellbore 114 to position the wellbore servicing system 100 at the selected depth.

While the operating environment depicted in FIG. 1 refers to a stationary servicing rig 106 for lowering and setting the wellbore servicing system 100 within a land-based wellbore 114, in alternative embodiments, mobile workover rigs, wellbore servicing units (such as coiled tubing units), and the like may be used to lower a wellbore servicing system into a wellbore. It should be understood that a wellbore servicing system may alternatively be used in other operational environments, such as within an offshore wellbore operational environment.

The subterranean formation 102 may comprise a zone 150. In alternative embodiments, the subterranean formation 102 may comprise any number of zones in addition to zone 150, for example, which are offset from each other along the length of the wellbore 114.

In an embodiment, the wellbore servicing system 100 may comprise a wellbore servicing tool 200. In an alternative embodiment, the wellbore servicing system 100 may comprise any number of wellbore servicing tools in addition to wellbore servicing tool 200. The additional wellbore servicing tools may be the same as or different than wellbore servicing tool 200. The wellbore servicing tool 200 may extend from and/or be included with a suitable work string 112.

The wellbore servicing tool 200 may comprise a tool which utilizes an obturator seated in a baffle (e.g., as shown in FIGS. 2, 5, 6, and 7). Examples of wellbore servicing tool may include, but are not limited to, a sleeve system, a stimulation assembly, a fluid jetting apparatus, or combinations thereof. Embodiments of suitable wellbore servicing tools are disclosed in U.S. Patent Publication No. 2012/0205121 A1, U.S. Patent Publication No. US 2012/0205120 A1, U.S. Publication No. 2011/0088915 to Stanojcic et al., U.S. Publication No. 2010/0044041 to Smith et al., and U.S. Pat. No. 7,874,365 to East, et al., each of which is incorporated by reference in its entirety for all purposes.

As shown in FIG. 1, the wellbore servicing tool 200 may be positioned within the horizontal wellbore portion 118 of the wellbore 114 and engaged with the work string 112 proximate zone 150. In an alternative embodiment, the wellbore servicing tool 200 may be positioned in the vertical wellbore portion 116 of the wellbore 114. Any number of wellbore servicing tools in addition to wellbore servicing tool 200 may be engaged along the work string 112 in the horizontal wellbore portion 118 and/or the vertical wellbore portion 116 of the wellbore 114 (or any other portions).

It will be appreciated that zone isolation devices such as annular isolation devices (e.g., annular packers and/or swell-packers) may be selectively disposed within wellbore 114 in a manner that restricts fluid communication between a space (e.g., zone 150) and another space or spaces (e.g., another zone or zones) uphole and/or downhole of each annular isolation device.

Figure 2:
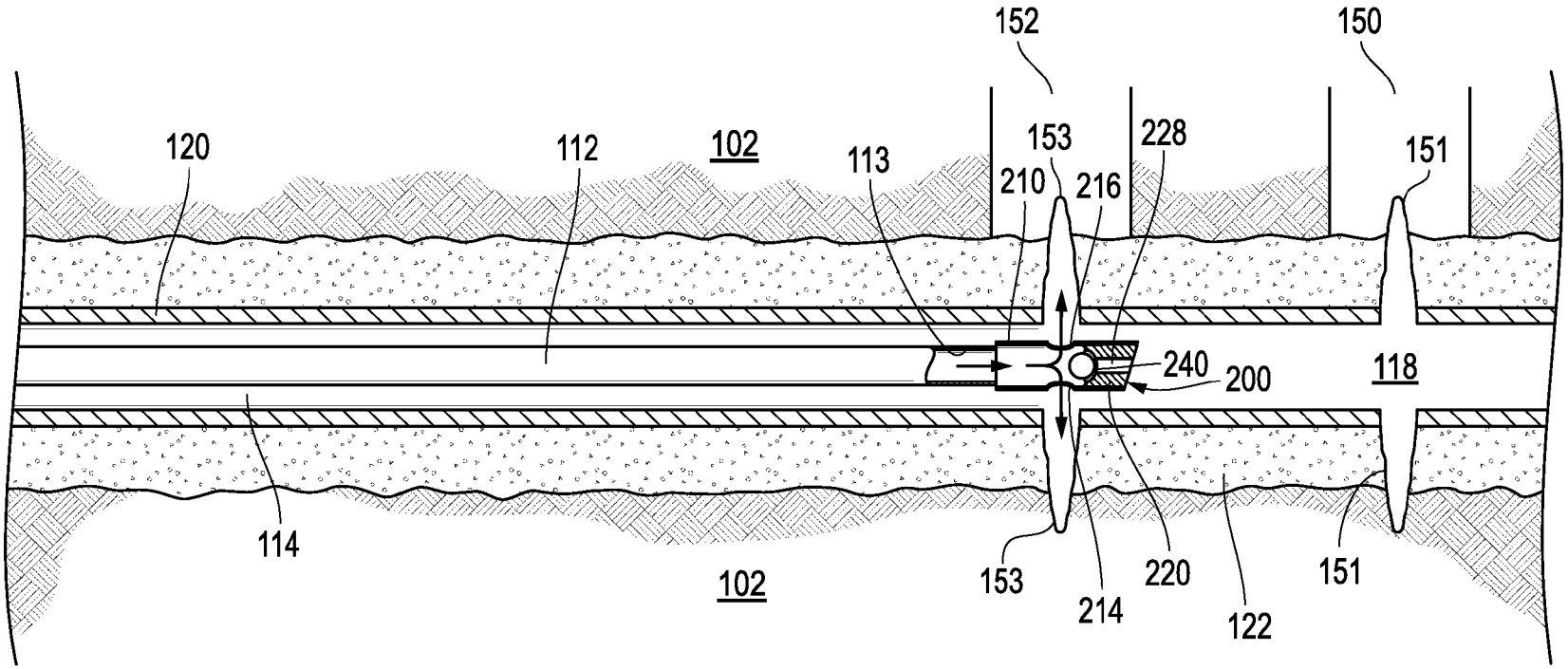
FIG. 2 is a partial cut-away view of the horizontal wellbore portion of the wellbore operating environment of FIG. 1.

Referring to FIG. 2, the horizontal wellbore portion 118 of the wellbore operating environment of FIG. 1 is shown. The end of the work string 112 and the wellbore servicing tool 200 are shown in cross-section. The wellbore servicing tool 200 may comprise the work string 112, a housing 210, a baffle 220, an obturator 240, or combinations thereof. As can be seen in the embodiment of FIG. 2, the wellbore servicing tool 200 may comprise a housing 210, a baffle 220 engaged within the housing 210, and an obturator 240 placed in the housing 210 and received by the baffle 220. In an alternative embodiment, the baffle 220 may engage an inner surface 113 of the work string 112 (e.g., at least a portion of the work string 112 may serve as the housing). The various components of the wellbore servicing tool 200 are discussed in further detail in the description for FIGS. 3 to 7 below.

Wellbore servicing operations may be generally accomplished by providing a wellbore 114 penetrating the subterranean formation 102, placing the wellbore servicing tool 200 in the wellbore 114, placing the work string 112 into the wellbore 114 (e.g., the tool 200 being coupled to the work string 112), introducing the obturator 240 into the work string 112, forward-flowing the obturator 240 (e.g., with a fluid such as a wellbore servicing fluid) to engage the obturator 240 with the baffle 220 (e.g., via a seat of the baffle 220, discussed in detail below), receiving the obturator 240 (e.g., the spherical zone thereof, discussed below) in the baffle 220 (e.g., in the seat thereof, discussed below), flowing a wellbore servicing fluid through the wellbore servicing tool 200 (e.g., through an opening of the tool 200), ejecting the obturator 240 from the baffle 220 (e.g., the seat thereof) using a pressure less than about 800 psi, ejecting the obturator 240 from the baffle 220 (e.g., the seat thereof) using a pressure of about 100 psi, or combinations thereof. In additional embodiments, the step of flowing the wellbore servicing fluid may comprise drilling a wellbore 114 in the subterranean formation 102, fracturing the subterranean formation 102, perforating the casing 120, stimulating the subterranean formation 102, or combinations thereof. In additional or alternative embodiments, the obturator 240 may flow through the work string 112 via pumped fluid(s), gravity, density (e.g., the obturator 240 may have a higher density than the fluid(s) in the work string 112 which causes the obturator 240 to forward-flow through the work string 112 to the baffle 220), or combinations thereof. Upon engaging the baffle 220 (e.g., via the seat of the baffle 220, discussed in detail below), the obturator 240 may provide a substantial fluid seal against the continued flow of fluid through the baffle 220 (e.g., via a flowbore of the baffle 220, discussed in detail below).

In an embodiment, the wellbore servicing method may include introducing the obturator 240 into the work string 112 and forward-flowing the obturator 240 to engage a seat of the baffle 220 within the wellbore servicing tool 200 which comprises a fluid jetting apparatus. The fluid jetting apparatus may be configured to perforate the casing 120, perforate the cement 122, and fracture a zone 150 of the subterranean formation 102 (e.g., by providing a route of fluid flow into the wellbore 114 via one or more openings formed in the housing 210 and by obscuring a flowbore of the baffle 220). The wellbore servicing method may further comprise positioning the wellbore servicing tool 200 (e.g., as a fluid jetting apparatus) proximate and/or substantially adjacent to the zone (e.g., zone 150 and/or 152) into which a perforation and/or fracture is to be made, and pumping a suitable perforating fluid or fracturing fluid via the work string 112 to the wellbore servicing tool 200. The fluid may be pumped at rate and/or pressure such that the fluid is emitted from the wellbore servicing tool 200 at a rate and/or pressure sufficient to erode, abrade, and/or degrade walls of the adjacent and/or proximate casing 120, the cement 122 surrounding the casing 120, the subterranean formation 102, or combinations thereof. The wellbore servicing fluid may be returned to the surface 104, e.g., via a flowpath comprising an annular space between the work string 112 and the casing 120.

The arrows drawn in FIG. 2 demonstrate the flow path of a wellbore servicing fluid (e.g., a drilling fluid, a spacer fluid, a sealant, a gravel pack, a fracturing fluid, a composite fluid (e.g., the composite treatment fluid disclosed in U.S. Publication No. 2010/0044041 to Smith et al., which is incorporated herein in its entirety), a storage fluid (e.g., $CO_2$), a stimulation fluid (e.g., an acid), water (e.g., freshwater, seawater, a brine, or combinations thereof), or combinations thereof) through the wellbore servicing tool 200 when the obturator 240 is received by (additionally or alternative, engaged with the seat of) the baffle 220.

In an embodiment, the wellbore servicing tool 200 may be selectively configurable to deliver a volume of a wellbore servicing fluid at a desired pressure. For example, the wellbore servicing tool 200 may be configured to flow a relatively low-volume of a wellbore servicing fluid into the wellbore 114 at a relatively high-pressure (e.g., as would be suitable for a perforating operation). Alternatively, the wellbore servicing tool 200 may be configured to flow a relatively high-volume of a wellbore servicing fluid into the wellbore 114 at a relatively low-pressure (e.g., as would be suitable for a fracturing operation). Alternatively, the wellbore servicing tool 200 may be configured to flow a relatively high-volume of a wellbore servicing fluid into the wellbore 114 at a relatively high-pressure. Alternatively, the wellbore servicing tool 200 may be configured to flow a relatively low-volume of a wellbore servicing fluid into the wellbore 114 at a relatively low-pressure. Alternatively, the wellbore servicing tool 200 may be configured to flow a volume of wellbore servicing fluid at a pressure suitable for stimulating the subterranean formation 102.

As shown in the embodiment of FIG. 2, the wellbore servicing tool 200 may be used to perforate a casing 120, to create a fracture 151 in zone 150 of the subterranean formation 102, and to create a fracture 153 in zone 152 in the subterranean formation 102. The wellbore servicing tool 200 may be moved through the wellbore 114 by the work string 112 and positioned to perform other wellbore servicing operations (e.g., drilling, perforating, fracturing, stimulating, etc.).

Figure 3:
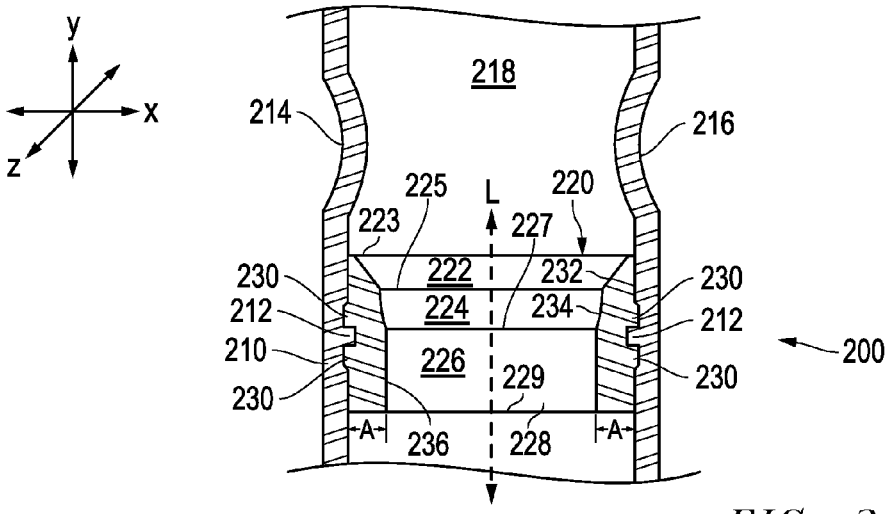
FIG. 3 is a cross-sectional view of an embodiment of the wellbore servicing tool.

Referring to FIG. 3, a cross-section view of the wellbore servicing tool 200 is shown. The baffle 220 of the tool 200 is engaged within the housing 210. For example, to engage with the housing 210, one or more lips 230 of the baffle 220 may interlock with one or more lips 212 of the housing 210. In additional or alternative embodiments, the baffle 220 may be engaged within the housing 210 by other permanent or non-permanent means, such as wedging, welding, adhesives, or combinations thereof.

In an embodiment, the housing 210 of the wellbore servicing tool 200 may be configured to couple with the work string 112. The housing 210 may comprise a hollow portion 218 so as to contain wellbore servicing equipment (e.g., baffle 220 and obturator 240), to receive a wellbore servicing fluid therein, to direct a wellbore servicing fluid therethrough, or combinations thereof. As can be seen in FIG. 2, embodiments of the housing 210 may comprise one or more openings (e.g., openings 214 and 216) formed in the housing 210. In an alternative embodiment where the work string 112 serves as the housing, openings 214 and 216 may comprise perforations formed in the work string 112. The openings 214 and 216 are configured to allow a wellbore servicing fluid to flow from within work string 112, through the openings 214 and 216, and into the wellbore 114. The openings 214 and 216 may be associated with a window device (e.g., pneumatic, hydraulic, electronic, mechanic, or combinations thereof) configured to open and close a window associated with one or both of openings 214 and 216. In such embodiments, fluid may flow through the opening when the window device is in the open position, and fluid may not flow through the opening when the window device is in the closed position. Embodiments of suitable window devices are disclosed in U.S. Patent Publication No. 2010/243,253 to Surjaatmadja et al., which is incorporated by reference herein in its entirety. In embodiments, the openings 214 and 216 may be oriented to face the subterranean formation (e.g., subterranean formation 102 of FIGS. 1 and 2). Fluid may flow through the openings 214 and 216 directly into the wellbore 114, indirectly into the wellbore 114 (e.g., via a flow device such as a jet, a nozzle, or both, which is cooperative with openings 214 and 216 shown in FIG. 3), or both.

In an embodiment, the baffle 220 (or collar) may comprise a top section 222, a seat 224, a bottom section 226, or combinations thereof. In an embodiment, the seat 224 may be formed in the baffle 220 between the top section 222 and the bottom section 226. In embodiments, at least a portion (e.g., the bottom section 226) of the baffle 220 may have a thickness A (as measured in the X-Z plane of FIG. 3) which is less than about 10, 9, 8, 7, 6, 5, 4, 3, 2.5, 2, 1.5, 1, 0.5, 0.25, or less inches. In embodiments, the top section 222, the seat 224, the bottom section 226, or combinations thereof may be integrally formed. In embodiments, the baffle 220 may have a flowbore 228 formed therein. For example, the bottom section 226, the seat 224, and the top section 222 may individually or in combination form a flowbore 228 through which a fluid (e.g., a wellbore servicing fluid) may pass (e.g., in embodiments where the obturator 240 does not obstruct the flowbore 228). In an alternative embodiment, the collar or baffle 220 may have the configurations discussed herein, and the baffle 220 may be engaged with an interior surface of the work string 112 (e.g., the work string 112 may serve as the housing).

In embodiments, the top section 222 may be angled such that top section 222 extends further radially inwardly at opposite end 225 of the top section 222 than at end 223 of the top section 222. In additional embodiments, the top section 222 may comprise a wall 232 which is angled such that wall 232 extends further radially inwardly at opposite end 225 of the top section 22 than at end 223 of the top section 222. The angle of the wall 232 of the top section 222 may be range from about 0° to about 90° with respect to the longitudinal axis L of the baffle 220. Such an angled configuration may guide an obturator (e.g., obturator 240 of FIG. 1 or 5, obturator 250 of FIG. 7) into the seat 224 of the baffle 220. In an embodiment, the top section 222 may form a flowbore 228 therein. In an embodiment, the top section 222 may comprise a chamfer, and the wall 232 may extend at a 45° angle with respect to the longitudinal axis L of the baffle 220.

Figure 5:
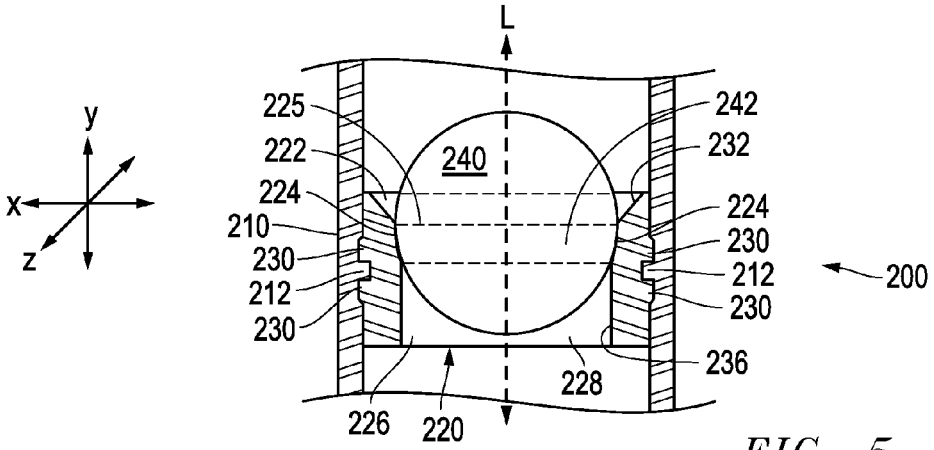
FIG. 5 is a cross-sectional view of the wellbore servicing tool shown in FIG. 3 with an obturator placed therein.
Figure 7:
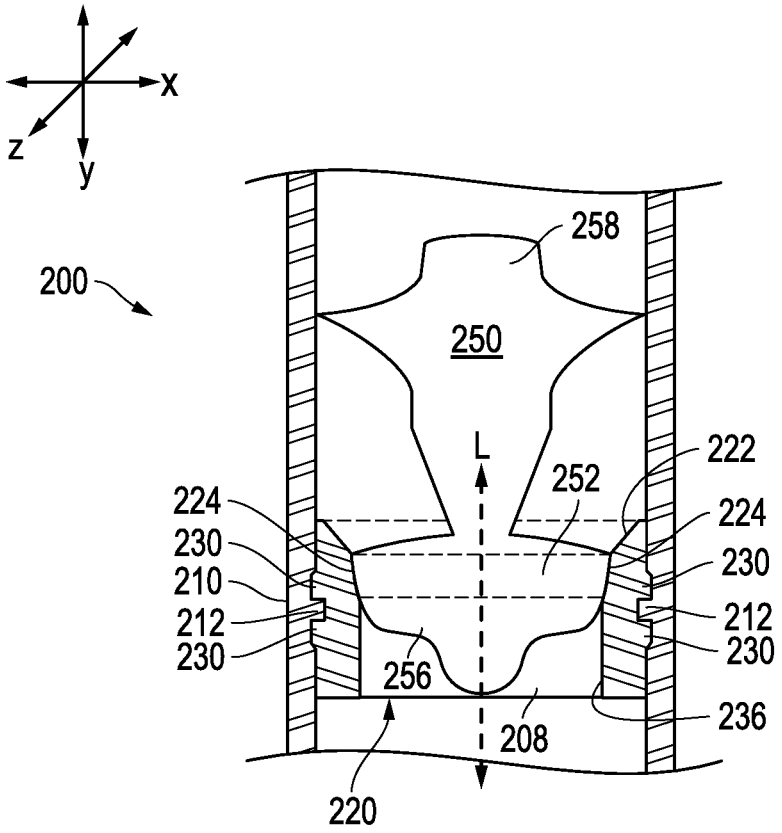
FIG. 7 is a cross-section view of the wellbore servicing tool shown in FIG. 3 with another embodiment of an obturator placed therein.

In embodiments, the seat 224 may have a contour which matches the contour of a spherical zone of an obturator (e.g., obturator 240 of FIG. 2 or 5, obturator 250 of FIG. 7). In additional embodiments, the seat 224 may comprise a wall 234 having a contour which matches the contour of a spherical zone of an obturator. In embodiments, the wall 234 may comprise a curved surface. In additional embodiments, the wall 234 may comprise a rounded indentation in the baffle 220. In embodiments, the seat 224 may extend further radially inwardly at end 227 of the seat 224 than at end 225 of the seat 224. In additional embodiments, the wall 234 of the seat 224 may extend further radially inwardly at end 227 of the seat 224 than at end 225 of the seat 224. In an embodiment, an entire surface (e.g., the wall 234) of the seat 224 may contact the spherical zone of an obturator. In an embodiment, the seat 224 may form a flowbore 228 therein. In an embodiment, the seat 224 may comprise a 360° concave surface. In an additional embodiment, the seat 224 may comprise a wall 234 which forms the 360° concave surface.

In embodiments, the bottom section 226 may have hollow-cylindrical shape. The bottom section 226 may comprise a wall 236. The bottom section 226 and/or wall 236 may extend radially inwardly for about an equal distance A at end 227 and opposite end 229 of the bottom section 226. As described above, distance A (as measured in the X-Z plane of FIG. 3) may be less than about 10, 9, 8, 7, 6, 5, 4, 3, 2.5, 2, 1.5, 1, 0.5, 0.25, or less inches. In an embodiment, the bottom section 226 may form a flowbore 228 therein.

Figure 4:
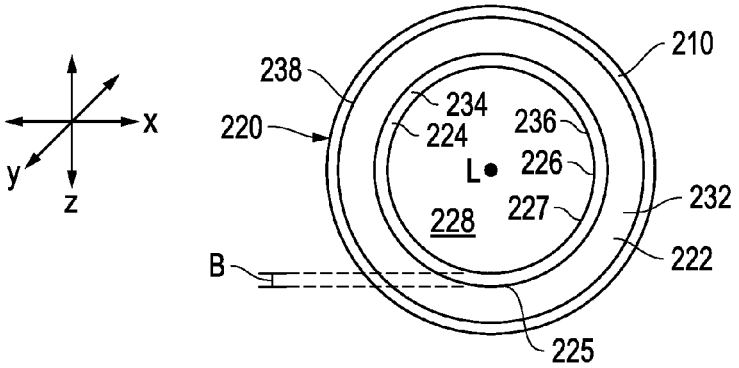
FIG. 4 is a top view of the embodiment baffle of the wellbore servicing tool shown in FIG. 3.

Referring to FIG. 4, a top view of an embodiment of the wellbore servicing tool 200 is shown. As seen in the embodiment of FIG. 4, the baffle 220 may have an annular shape. Additionally, the housing 210 may have an annular shape. In embodiments, the wall 232 of the top section 222 may have a circular shape, the wall 234 of the seat 224 may have a circular shape, the wall 236 of the bottom section 226 may have a circular shape, or combinations thereof. In an alternative embodiment, the wall 234 of the seat 224 may have a circular shape, which the wall 232 of the top section 222 and the wall 236 of the bottom section 226 may have other geometric shapes (e.g., square, rectangle, pentagon, hexagon). In additional embodiments, an outside surface 238 of the baffle 220 may have any shape configured to engage the housing 210, e.g., circular as shown in FIG. 4 or other shapes such as a polygon. In embodiments, the baffle 220 may comprise segments which form a whole piece, said segments forming the seat 224 and flowbore 228 when assembled; alternatively, the baffle 220 may comprise a unitary piece. In embodiments, a diameter (e.g., inner diameter and/or outer diameter as measured in the X-Z plane of FIG. 4) of the baffle 220 (e.g., top section 222, seat 224, bottom section 226, or combinations thereof) is about 5 inches or less than 5 inches. Also as can be seen in FIG. 4, the top section 222, the seat 224, and the bottom section 226 collectively form a flowbore 228.

In FIG. 4, the seat 224 extends radially inwardly for distance B from end 225 to opposite end 227 of the seat 224. Distance B (as measured in the X-Z plane of FIG. 4) may be less than about 0.5 inches. In embodiments, the diameter of the end 225 of the seat 224 may have about the same diameter as an obturator or may be slightly larger or smaller than the diameter of the obturator as specified herein. In an embodiment, a radius of the seat 224 (which extends from longitudinal axis L to the surface of the seat 224) may be centered on a line which intersects where the top section 222 (e.g., a chamfer) would intersect the diameter of the end 225 of the seat 224. Instead of providing only a point of contact with an obturator (e.g., obturator 240), the seat 244 as disclosed herein may provide a surface of contact via the wall 234 of the seat 224. The surface of contact (e.g., the 360° concave surface) of the seat 224 may provide a larger contact area (e.g., the surface area of the surface of contact) than would a point of contact (e.g., a knife edge). The channel 228 of the baffle 220 extends through the baffle in the direction of the longitudinal axis L of the baffle 220.

Referring to FIG. 5, a cross-sectional view of the wellbore servicing tool 200 is shown with obturator 240 placed therein. The wellbore servicing tool 200 of FIG. 5 comprises the same housing 210 and baffle 220 described for FIG. 3. FIG. 5 further shows the obturator 240 engaged with the seat 224 of the baffle 220. In embodiments, the baffle 220 may be configured so that the flowbore 228 of the baffle 220 is obstructed when the baffle 220 engages with the obturator 240.

In embodiments, the obturator 240 may comprise any structure or device which comprises a spherical zone to engage the seat 224 and, thereby, restrict or lessen the movement of fluid(s) via the flowbore 228. In an embodiment, the spherical zone may include the surface of the portion of an obturator (e.g., obturator 240) which resembles a spherical segment, regardless whether the portion of the obturator is hollow, solid, or a combination thereof. A spherical segment is a geometric term which may be defined as the shape formed when a sphere is cut by two parallel planes. In additional or alternative embodiments, the obturator 240 may comprise a 360° convex surface; additionally or alternatively, a spherical zone of the obturator 240 may comprise a 360° convex surface. As shown in the embodiment of FIG. 5, the obturator 240 may comprise a sphere (e.g., a ball).

FIG. 5 shows an example of a spherical zone 242 of an obturator 240. In an embodiment, the spherical zone 242 may comprise a 360° convex surface. A suitable spherical zone (e.g., spherical zone 242) of the obturator 240 may be located on the lower half of the obturator 240, e.g., when viewed in the X-Y plane in FIG. 5. The spherical zone 242 and the wall 234 of the seat 224 may have about the same height (as measured in Y values in the X-Y plane of FIG. 5).

In embodiments, the surface area of the spherical zone 242 is from about 0.01% to about 50% of the total surface area of the obturator 240; alternatively, from about 1% to about 40% of the total surface area of the obturator 240; alternatively, from about 5% to about 40% of the total surface area of the obturator 240. In embodiments, the surface area of the 360° convex surface (e.g., of the spherical zone 242 of the obturator 240) is from about 0.01% to about 50% of the total surface area of the obturator 240; alternatively, from about 1% to about 40% of the total surface area of the obturator 240; alternatively, from about 5% to about 40% of the total surface area of the obturator 240.

In an embodiment, the surface area of the spherical zone 242 is in greater than about 50% contact with the contact area of the seat 224 of the baffle 220; alternatively, in greater than about 75% contact; alternatively, in greater than about 90% contact; alternatively, in greater than about 95% contact; alternatively, in about 96% contact, in about 97% contact, in about 98% contact, in about 99% contact, or in about 100% contact. In an embodiment, a surface area of the 360° concave surface of the obturator 240 is in greater than about 50% contact with the contact area of the 360° convex surface of the seat 224 of the baffle 220; alternatively, in greater than about 90% contact; alternatively, in greater than about 95% contact; alternatively, in about 96% contact, in about 97% contact, in about 98% contact, in about 99% contact, or in about 100% contact.

In an embodiment, the obturator 240 is configured such that the obturator 240 may not fall out of the housing 210 and/or work string 112, for example, during placement of the obturator 240 in the baffle 220, during movement past the openings 214 and 216 of the housing 210, and/or during movement past any perforation of the work string 112.

In embodiments, the obturator 240 may be a solid ball, a hollow ball, or have both solid and hollow portions. In embodiments, the obturator 240 may comprise a single material; alternatively, the obturator 240 may comprise a combination of materials (e.g., a first material and a second material).

Figure 6:
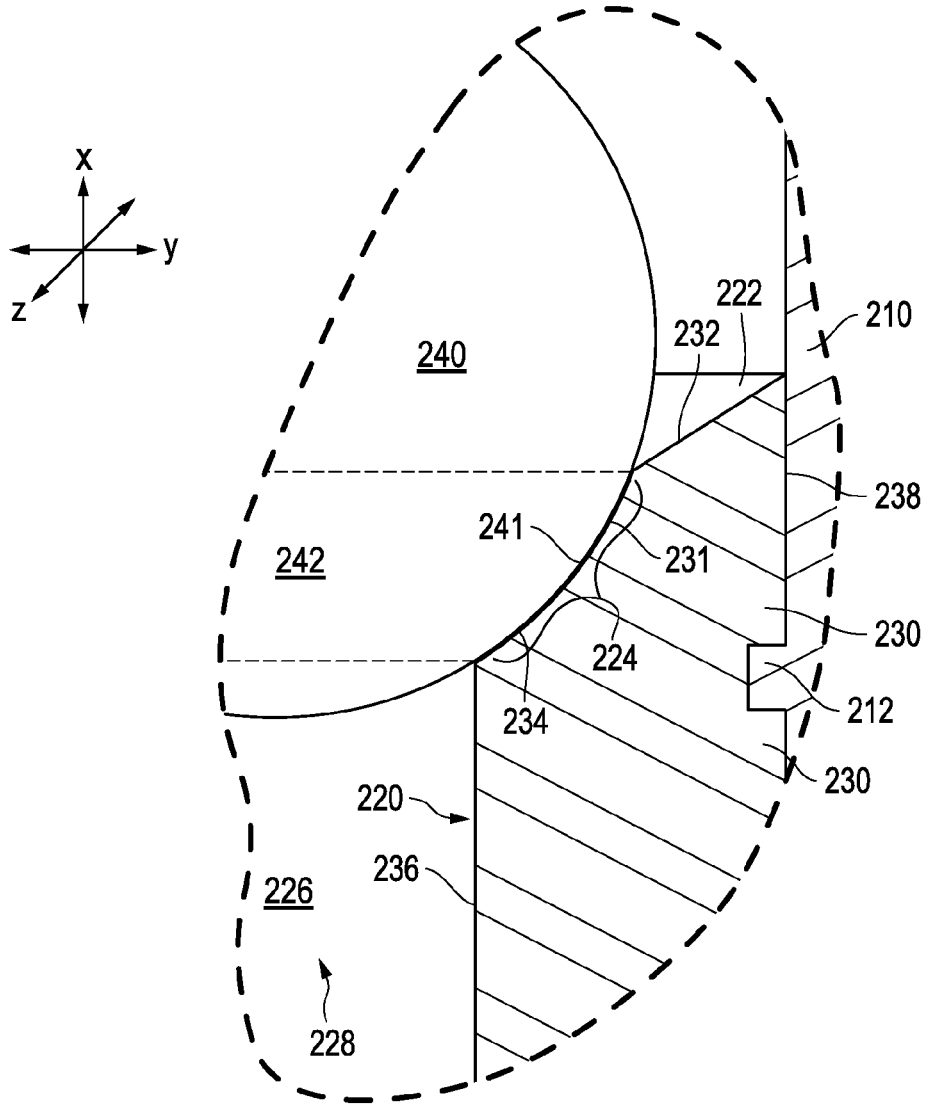
FIG. 6 is an isolated cross-sectional view of the wellbore servicing tool shown in FIG. 5.

Referring to FIG. 6, an isolated cross-sectional view of the wellbore servicing tool 200 of FIG. 5 is shown. The engagement of the spherical zone 242 of the obturator 240 with the wall 234 of the seat 224 can be seen. The surface of contact between the spherical zone 242 and the seat 224 shows the seat 224 is contoured to match the spherical zone 242 of the obturator 240.

In embodiments, "contoured to match" may include a seat 224 which is contoured as a function of the outer diameter of the obturator 240, which is contoured as a function of the amount of interference fit (or press fit) desired between the obturator 240 and the seat 224, or combinations thereof. For example, a higher surface area of the spherical zone 242 of the obturator 240 (e.g., from about 0.01% to about 50% of the total surface area of the obturator 240 as described herein) which contacts a contact area of the seat 224 with a high percentage of contact between the surface area of the spherical zone 242 and the seat 224 provides more contact (e.g., greater than about 75% as described above) between the obturator 240 and the seat 224 and reduces the press fit between the obturator 240 and the seat 224 (e.g., relative to a knife-edge seat).

In embodiments which are "contoured to match," the seat 224 may comprise a radius of curvature equal to a radius of curvature of the spherical zone 242 of the obturator 240; alternatively, the seat 224 may comprise a radius of curvature about equal to the radius of curvature of the spherical zone 242 of the obturator 240; alternatively, the seat 224 may comprise a radius of curvature which is larger than the radius of curvature of the spherical zone 242 of the obturator 240.

In embodiments which are "contoured to match," the seat 224 of the baffle 220 may have a radius which is about equal (e.g., about 0.001, 0.002, 0.003, 0.004, 0.005, 0.006, 0.007, 0.008, 0.009, 0.010, 0.011, 0.012, 0.013, 0.014, 0.015, 0.016, 0.017, 0.018, 0.019, 0.020, 0.021, 0.022, 0.023, 0.024, 0.025, or more inches larger or smaller than) to the radius of the obturator 240. Embodiments where the radius of the seat 224 of the baffle 220 is larger than the radius of the obturator 240 prevent and/or reduce the press fit (and failure associated with press fit) of the obturator 240 when engaged with the seat 224. Embodiments where the radius of the seat 224 of the baffle 220 is smaller than the radius of the obturator 240 may create a higher press fit than embodiments where the seat 224 of the baffle 220 has a radius larger than the radius of the obturator 240; however, the press fit created by the contoured seat 224 is significantly less than the press fit experienced by seats which are not "contoured to match" as disclosed herein (e.g., a knife edge).

In embodiments which are "contoured to match," the seat 224 of the baffle 220 may have a radius which is from about 0.12 inches to about 0.26 inches larger than the radius of the radius of the obturator 240; alternatively, the seat 224 of the baffle 220 may have a radius which is 0.020 inches larger than the radius of the obturator 240.

In embodiments, the obturator 240 may engage with the seat 224 of the baffle 220 by mating the 360° convex surface 241 of the obturator 240 with the 360° concave surface 231 of the seat 224. In additional or alternative embodiments, the obturator 240 may engage with the seat 224 of the baffle 220 by mating the 360° convex surface 241 of spherical zone 242 of the obturator 240 with the 360° concave surface 231 of the wall 234 of the seat 224.

Referring to FIG. 7, a cross-sectional view of the wellbore servicing tool 200 is shown with obturator 250 placed therein. The wellbore servicing tool 200 of FIG. 7 comprises the same housing 210 and baffle 220 described for FIG. 3. FIG. 7 further shows the obturator 250 engaged with the seat 224 of the baffle 220. As shown in the embodiment of FIG. 7, the obturator 250 may comprise a dart having a spherical zone 252 (e.g., on the head 256 of the dart). The dart may comprise a head 256 and a tail 258 connected to the head. The head 256 may comprise a spherical zone 252, and the tail 258 may comprise a configuration suitable for darts used in wellbore operating environments.

The embodiments disclosed herein are designed to provide improved support of an obturator (e.g., obturator 240 and/or 250) on a baffle 220 during wellbore servicing operations (e.g., drilling, fracturing, stimulating, perforating, or combinations thereof). By providing a seat 224 of the baffle 220 which is contoured as a function of the outer diameter of the obturator (e.g., obturator 240 and/or 250) and/or as a function of the interference fit between the obturator (e.g., obturator 240 and/or 250) and baffle 220, the press fit which occurs when the obturator (e.g., obturator 240 and/or 250) is engaged with the seat 224 of the baffle 220 is reduced. Any press-fit force is spread over the area of contact between the obturator (e.g., obturator 240 and/or 250) and the baffle 220, the force required to shear the obturator is increased, and the press fit force at any given point in the area of contact between the obturator and baffle is reduced. Reduced press fit may reduce the maximum pressure rating of the obturators disclosed herein. Also, by providing a seat 224 of the baffle 220 which is contoured to match the spherical zone of the obturator (e.g., obturator 240 and/or 250), the contact surface area allows for improved support of the obturator.

The embodiments disclosed herein are designed to provide a reduction in ejection pressures of an obturator (e.g., obturator 240 and/or 250) engaged with a baffle (e.g., baffle 220). By providing a seat 224 of the baffle 220 which is contoured as a function of the outer diameter of the obturator (e.g., obturator 240 and/or 250) and/or as a function of the interference fit between the obturator (e.g., obturator 240 and/or 250) and baffle 220, the press fit which occurs when the obturator (e.g., obturator 240 and/or 250) is engaged with the seat 224 of the baffle 220 is reduced. Reduced press fit allows for a reduction in ejection pressure of the obturator (e.g., less than 800 psi; alternatively, less than about 700 psi; alternatively, less than about 600 psi; alternatively, less than about 500 psi; alternatively, less than about 400 psi; alternatively, less than about 300 psi; alternatively, less than about 200 psi; alternatively, less than about 100 psi; alternatively, about 100 psig). For example, the obturator (e.g., obturator 240 and/or 250) may be moved (e.g., ejected) from the baffle 220 using the pressure of the fluid(s) produced from a zone of a subterranean formation. The flow and pressure from a zone of a subterranean formation can be relatively low, and the disclosed embodiments provide the ability to move the obturator from engagement with the baffle using a relatively low force, for example, the force provided by fluid produced from a zone of a subterranean formation.

The embodiments disclosed herein are designed to enable a greater number of obturator and baffle combinations to be used in wellbore operations such as fracturing and stimulating operations for multiple zones of a subterranean formation.

The embodiments disclosed herein may allow a wellbore servicing operation to be performed more quickly and efficiently, in relation to conventional methods of wellbore servicing. For example, because obturator support is improved and the ejection pressure of the obturator is reduced, obturator useful life may increase and lower fluid pressures may be required to move the obturator from engagement with the baffle. As such, efficiencies in re-use of the obturator and less severe operating conditions may result.

Additional Disclosure

The following are nonlimiting, specific embodiments in accordance with the present disclosure:

A first embodiment, which is a method for servicing a subterranean formation comprising providing a wellbore penetrating the subterranean formation; and placing a wellbore servicing tool in the wellbore, wherein the wellbore servicing tool comprises a baffle, wherein the baffle comprises a seat contoured to match a spherical zone of an obturator.

A second embodiment, which is the method of the first embodiment, further comprising receiving the spherical zone of the obturator in the seat of the baffle.

A third embodiment, which is the method of one of the first through second embodiments, further comprising ejecting the obturator from the seat of the baffle using a pressure less than about 800 psi.

A fourth embodiment, which is the method of the third embodiment, further comprising ejecting the obturator from the seat of the baffle using a pressure of about 100 psi.

A fifth embodiment, which is the method of one of the first through fourth embodiments, wherein the baffle comprises a flowbore, the method further comprising obstructing the flowbore of the baffle with the obturator.

A sixth embodiment, which is the method of the fifth embodiment, further comprising: flowing a wellbore servicing fluid through an opening of the wellbore servicing tool.

A seventh embodiment, which is the method of the sixth embodiment, wherein the step of flowing comprises fracturing the subterranean formation; perforating a casing; or stimulating the subterranean formation.

An eighth embodiment, which is the method of one of the first through seventh embodiments, wherein the obturator comprises a ball or a dart.

A ninth embodiment, which is the method of one of the first through eighth embodiments, further comprising placing a work string into the wellbore, wherein the wellbore servicing tool is coupled to the work string.

A tenth embodiment, which is the method of one of the first through ninth embodiments, further comprising introducing the obturator into a work string; and forward-flowing the obturator to engage the obturator with the seat of the baffle.

An eleventh embodiment, which is a wellbore servicing tool comprising an obturator comprising a spherical zone; and a baffle comprising a seat contoured to match the spherical zone of the obturator.

A twelfth embodiment, which is the wellbore servicing tool of the eleventh embodiment, wherein the seat of the baffle is configured to receive the spherical zone of the obturator.

A thirteenth embodiment, which is the wellbore servicing tool of the twelfth embodiment, wherein the baffle further comprises a flowbore formed therein, wherein the obturator is configured to obstruct the flowbore when the seat of the baffle receives the spherical zone of the obturator.

A fourteenth embodiment, which is the wellbore servicing tool of one of the eleventh through thirteenth embodiments, further comprising a housing comprising one or more openings, wherein the baffle is engaged with the housing, wherein the one or more openings are configured to direct a flow of a wellbore servicing fluid into a wellbore.

A fifteenth embodiment, which is the wellbore servicing tool of one of the eleventh through fourteenth embodiments, further comprising a portion of a work string, wherein the baffle is engaged with the portion of the work string.

A sixteenth embodiment, which is the wellbore servicing tool of one of the eleventh through fifteenth embodiments, wherein the obturator comprises a ball or a dart.

A seventeenth embodiment, which is a baffle for use in a wellbore servicing operation comprising a seat contoured to match a spherical zone of an obturator.

An eighteenth embodiment, which is the baffle of the seventeenth embodiment, further comprising a top section angled to guide the obturator to the seat; and a bottom section, wherein the seat is formed between the top section and the bottom section.

A nineteenth embodiment, which is the baffle of the eighteenth embodiment, wherein the bottom section forms a flowbore.

A twentieth embodiment, which is the baffle of one of the seventeenth through nineteenth embodiments, wherein a radius of curvature of the seat is equal to the radius of curvature of the spherical zone of the obturator.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A method for servicing a subterranean formation comprising:

providing a wellbore penetrating the subterranean formation;

placing a wellbore servicing tool in the wellbore, wherein the wellbore servicing tool comprises a baffle, wherein the baffle comprises a top section, a seat, and a bottom section, wherein the seat is contoured to match a spherical zone of an obturator, wherein the top section and the seat define a first seat end and the bottom section and seat define a second seat end, wherein the second seat end extends further inward radially than the first seat end, wherein the radius of the contoured seat is within 0.025 inches of the radius of the spherical zone of the obturator;

receiving the spherical zone of the obturator in the seat of the baffle; and ejecting the obturator from the baffle using a force provided by fluid produced from the subterranean formation.

2. The method of claim 1, further comprising ejecting the obturator from the seat of the baffle using a pressure of about 100 psi.

3. The method of claim 1, wherein the baffle comprises a flowbore, the method further comprising obstructing the flowbore of the baffle with the obturator.

4. The method of claim 3, further comprising:

flowing a wellbore servicing fluid through an opening of the wellbore servicing tool.

5. The method of claim 4, wherein the step of flowing comprises:

fracturing the subterranean formation;

perforating a casing; or stimulating the subterranean formation.

6. The method of claim 1, wherein the obturator comprises a ball or a dart.

7. The method of claim 1, further comprising placing a work string into the wellbore, wherein the wellbore servicing tool is coupled to the work string.

8. The method of claim 1, further comprising:

introducing the obturator into a work string; and forward-flowing the obturator to engage the obturator with the seat of the baffle.

9. The method of claim 1, the force provided by fluid produced from the subterranean formation is a pressure of less than 800 psi.

10. A wellbore servicing tool comprising:

an obturator comprising a spherical zone; and a baffle comprising a top section, a seat, and a bottom section, wherein the seat is contoured to match the spherical zone of the obturator, wherein the top section and the seat define a first seat end and the bottom section and seat define a second seat end, wherein the second seat end extends further inward radially than the first seat end, wherein the radius of the contoured seat is within 0.025 inches of the radius of the spherical zone of the obturator; and wherein the obturator and baffle are structured and arranged such that the obturator is ejected from the baffle by fluid produced from the subterranean formation.

11. The wellbore servicing tool of claim 10, wherein the seat of the baffle is configured to receive the spherical zone of the obturator.

12. The wellbore servicing tool of claim 11, wherein the baffle further comprises a flowbore formed therein, wherein the obturator is configured to obstruct the flowbore when the seat of the baffle receives the spherical zone of the obturator.

13. The wellbore servicing tool of claim 10, further comprising:

a housing comprising one or more openings, wherein the baffle is engaged with the housing, wherein the one or more openings are configured to direct a flow of a wellbore servicing fluid into a wellbore.

14. The wellbore servicing tool of claim 10, further comprising:

a portion of a work string, wherein the baffle is engaged with the portion of the work string.

15. The wellbore servicing tool of claim 10, wherein the obturator comprises a ball or a dart.

16. The wellbore servicing tool of claim 10, wherein the fluid produced from the subterranean formation provides a pressure of less than 800 psi to move the obturator out of engagement with the baffle.

17. A baffle for use in a wellbore servicing operation comprising:

a top section, a seat, and a bottom section, wherein the seat is contoured to match a spherical zone of an obturator, wherein the top section and the seat define a first seat end and the bottom section and seat define a second seat end, wherein the second seat end extends further inward radially than the first seat end; and, when the obturator and seat are engaged, wherein the radius of the contoured seat is within 0.025 inches of the radius of the spherical zone of the obturator, a pressure provided by fluid produced from a subterranean formation is capable of ejecting the obturator from the seat.

18. The baffle of claim 17, wherein the top section is angled to guide the obturator to the seat; and the seat is formed between the top section and the bottom section.

19. The baffle of claim 18, wherein the bottom section forms a flowbore.

20. The baffle of claim 17, wherein the radius of curvature of the seat is equal to the radius of curvature of the spherical zone of the obturator.

* * * * *